US009196136B2

(12) United States Patent
King

(10) Patent No.: US 9,196,136 B2
(45) Date of Patent: Nov. 24, 2015

(54) DEVICE AND METHOD FOR MONITORING LOCKING DEVICES

(71) Applicant: Gregory E. King, El Cajon, CA (US)

(72) Inventor: Gregory E. King, El Cajon, CA (US)

(73) Assignee: Indyme Solutions, LLC, San Diego, CA (US)

( * ) Notice: Subject to any disclaimer, the term of this patent is extended or adjusted under 35 U.S.C. 154(b) by 11 days.

(21) Appl. No.: 14/027,550

(22) Filed: Sep. 16, 2013

(65) Prior Publication Data

US 2015/0077252 A1 Mar. 19, 2015

(51) Int. Cl.

| | |
|---|---|
| ***E05B 45/06*** | (2006.01) |
| ***G08B 13/06*** | (2006.01) |
| ***H01H 36/00*** | (2006.01) |
| ***E05B 39/04*** | (2006.01) |
| ***E05B 65/08*** | (2006.01) |
| ***E05C 19/18*** | (2006.01) |

(52) U.S. Cl.

CPC ..... *G08B 13/06* (2013.01); *E05B 39/04* (2013.01); *E05B 45/06* (2013.01); *E05B 65/0894* (2013.01); *E05C 19/18* (2013.01); *H01H 36/0046* (2013.01)

(58) Field of Classification Search

CPC ..... E05B 45/06; H01H 36/0046

USPC ..... 340/542, 547

See application file for complete search history.

(56) References Cited

U.S. PATENT DOCUMENTS

| | | | | |
|---|---|---|---|---|
| 8,269,627 | B2 * | 9/2012 | Gore et al. | 340/547 |
| 8,624,736 | B2 * | 1/2014 | Gore et al. | 340/547 |
| 8,854,207 | B2 * | 10/2014 | Williams | 340/539.13 |
| 2006/0149871 | A1 * | 7/2006 | Marshall et al. | 710/72 |
| 2012/0227450 | A1 * | 9/2012 | Ufkes | 70/277 |
| 2012/0229251 | A1 * | 9/2012 | Ufkes | 340/5.26 |
| 2012/0310716 | A1 * | 12/2012 | Jankowski et al. | 705/14.4 |
| 2014/0028443 | A1 * | 1/2014 | Ebner | 340/10.1 |
| 2014/0109631 | A1 * | 4/2014 | Asquith et al. | 70/15 |

* cited by examiner

*Primary Examiner* — John A Tweel, Jr.

(74) *Attorney, Agent, or Firm* — Lewis Kohn & Walker LLP; David M. Kohn; Kari Moyer-Henry

(57) ABSTRACT

Disclosed is a lock monitor module for attachment to a locking device, comprising: a sensor in communication with a detection unit for generating a locking device status signal representative of a locked state, an unlocked state, a tampered state, or a distressed state of the locking device, the sensor proximate to a lock component of the locking device; a lock monitor and evaluation software app in communication with the detection unit for receiving the locking device status signal; and a transceiver for transmitting at least one of an alarm signal and a notification signal in response to the locking device status signal.

20 Claims, 6 Drawing Sheets

DEVICE AND METHOD FOR MONITORING LOCKING DEVICES

FIELD OF THE INVENTION

The present invention relates to a device and method for monitoring the locking of cabinets, fenced-off areas, and similar enclosures such as may be utilized in a retail commerce setting.

BACKGROUND OF THE INVENTION

Many retail establishments find it necessary to keep certain commercial merchandise in a locked enclosure to reduce losses due to theft. Among the types of locking devices in common usage is a display cabinet showcase lock 10, as shown in FIG. 1 configured for securing sliding glass panes in a display cabinet (not shown). The display cabinet showcase lock 10, configured here as a clip-on locking ratchet assembly, includes a locking barrel 12 configured to be selectively positioned along a toothed edge segment 18 of a flat bar 16.

The flat bar 16 also includes a clamp section 14 configured to fit onto an edge of a first glass pane. The locking barrel 12 is moved into position along the toothed edge segment 18, and then secured to the flat bar 16 by turning a key 28 inserted into the locking barrel 12. Relative movement between the two glass panes is prevented when the base of the locking barrel 12 butts up against the edge of a second glass pane, and locked in place with the key 28.

Although a conventional display cabinet showcase lock serves to reduce merchandise loss and damage, use of such locks may also prevent a customer from accessing and handling the merchandise where there is no sales associate available to help the customer. This situation could frustrate the customer, who may forego a purchase because the merchandise is not accessible for hands-on examination or for purchase, without assistance from the sales associate.

Moreover, use of conventional display cabinet showcase locks have other shortcomings. For example, a retail employee might not think to close an open display case when going to assist a customer in another area of the store, and may thus unintentionally leave the display cabinet unlocked. The retail employee may also leave the display cabinet intentionally unlocked when not certain of having access to the key 28 at a later time. Unfortunately, this often results in the unprotected merchandise being susceptible to loss from theft. And in some cases, even when the display cabinet is locked, a determined thief may force the locking barrel 12 from the flat bar 16.

There is a need for a locking device and method of monitoring secured merchandise which overcomes the above noted shortcomings of the present state of the art.

BRIEF SUMMARY OF THE INVENTION

In one aspect of the present invention, a lock monitor module suitable for attachment to a locking device comprises: a detection sensor in communication with a detection unit, the detection unit for generating a locking device status signal representative of at least one of a locked state, an unlocked state, a tampered state, or a distressed state of the locking device, the sensor proximate to a lock component of the locking device; a lock monitor and evaluation software app in communication with the detection unit for receiving the locking device status signal; and a transceiver for transmitting at least one of an alarm signal and a notification signal in response to receiving the locking device status signal from the lock monitor and evaluation software app.

In another aspect of the present invention, a monitored lock system comprises: a locking device for locking an enclosure, a lock monitor module attached to the locking device, the lock monitor module including a detection unit for generating a locking device status signal representative of a locked state of the locking device or an unauthorized state of the locking device, the lock monitor module further including a lock monitor and evaluation software app for converting the locking device status signal into at least one of an alarm signal configured for transmittal to a transceiver and a notification signal configured for transmittal to a mobile communication device.

In still another aspect of the present invention, a method of providing security for an item placed into a secured area comprises: attaching a lock monitor module to a locking device, the locking device emplaced so as to secure the area; placing the locking device into a locked state; monitoring the locking device so as to detect a change from the locked state; if an unauthorized lock opening has occurred to produce a change in the locked state, generating a locking device status signal; and transmitting at least one of an alarm signal and a notification signal in response to the step of generating said locking device status signal, the alarm signal configured for transmittal to a transceiver, the notification signal configured for transmittal to a mobile communication device.

The additional features and advantage of the disclosed invention is set forth in the detailed description which follows, and will be apparent to those skilled in the art from the description or recognized by practicing the invention as described, together with the claims and appended drawings.

BRIEF DESCRIPTIONS OF THE DRAWINGS

The foregoing aspects, uses, and advantages of the present invention will be more fully appreciated as the same becomes better understood from the following detailed description of the present invention when viewed in conjunction with the accompanying figures, in which.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention. The present invention relates generally to an electronic module that attaches to a cabinet lock or to a padlock, and overcomes the problems of the current state of the art by providing remote monitoring to establish the state of the attached lock as being locked, unlocked, or distressed.

Figure 2:
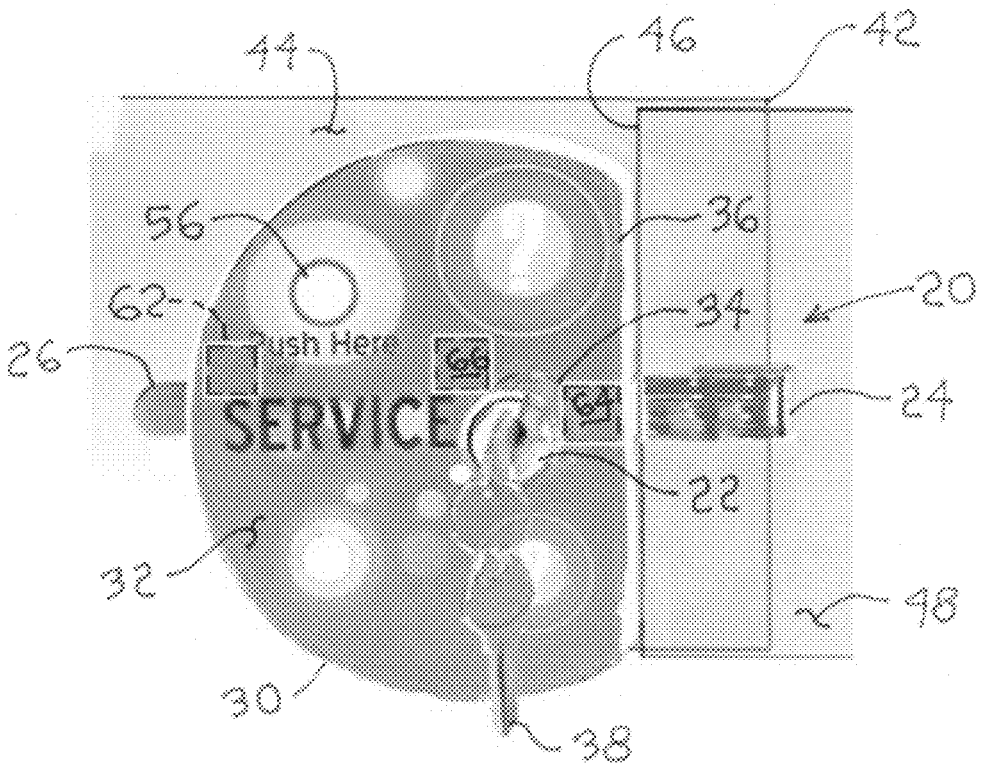
FIG. 2 is a pictorial illustration of a lock monitor module enclosing the locking barrel of a display cabinet showcase lock, in accordance with the present invention.

There is shown in FIG. 2 a lock monitor module 30 enclosing the locking barrel 22 of a display cabinet showcase lock 20 (partially hidden in the view). It should be understood that a display cabinet is used in the present specification for convenience of illustration, as an exemplary embodiment of one method of practicing the invention. It should be further understood that the disclosed system and method of monitoring locking devices can be applied to other situations in which a locking device is used to secure an enclosure or an open area, wherein the disclosed system is used to constantly monitor the locking status of the locking device.

It can be appreciated that the specific design of the lock monitor module 30 depends upon the particular display cabinet showcase lock 20 being monitored. Generally, the lock monitor module 30 may have incorporated one of various configurations of mounting or attachment methods, so as to allow use of an appropriate configuration of the lock monitor module 30 with any commercially-available display cabinet showcase lock. For example, in the illustration provided, the lock monitor module 30 has been adapted for use with sliding display doors.

The locking barrel 22 may be physically retained on a flat bar 26 along with the lock monitor module 30. One end of the flat bar 26 may be configured as a spring clamp 24 configured to clamp onto a planar object. In the embodiment shown, the lock monitor module 30 comprises a lock module housing 32 fabricated from a plastic material, for example. In the configuration shown, the lock module housing 32 has the shape of a truncated disc, and includes a module opening 34 to allow a user access to the locking barrel 22. The module opening is further sized to provide attachment to the display cabinet showcase lock 20, while allowing the locking barrel 22 to rotate within the lock module housing 32, for locking and unlocking by an authorized person.

The display cabinet showcase lock 20 is shown in a "locked" position, with the spring clamp 24 secured over a first edge 42 of a first glass pane 44. A module bearing face 36 of the lock monitor housing 32 may be placed against a second edge 46 of a second glass pane 48. When the display cabinet showcase lock 20 is secured and locked with the key 38, the imposition of the module bearing face 36 against the second edge 46 serves to prevent movement of the first glass pane 44 with respect to the second glass pane 48.

A sales associate may use a key 38, an unlocking combination, or other method known in the art to unlock the display cabinet showcase lock 20, and then slide the locking barrel 22 and the attached lock monitor module 30 off the flat bar 26. The lock monitor module 30 may sense various removal and opening actions by incorporating a proximity device, or a presence-indicating device disposed near the locking barrel 22 and/or the flat bar 26.

For example, the lock monitor module 30 may incorporate a magnetic sensor 64 (shown in phantom) that uses a magnetic component to detect when the locking barrel 22 is being rotated. Alternatively, the lock monitor module 30 may incorporate a mechanical switch 66 (shown in phantom) that activates a switch in response to removal of the locking barrel 22. In an exemplary embodiment, the lock monitor module 30 may incorporate an optical sensor 62 (shown in phantom) that uses reflected light to detect removal of the flat bar 26 from the lock module housing 32. It can be appreciated by one skilled in the art that the optical sensor 62, the magnetic sensor 64, and the mechanical switch 66, may be used individually or in combination, at any location in the lock module housing 32 that would result in a detection of the movement, removal, or rotation of either or both the locking barrel 22 and the flat bar 26.

Preferably, the customer may be provided a "help" button 56 for use in summoning assistance to unlock the display cabinet showcase lock 20. The help button 56 may be similar to a device disclosed and claimed in U.S. Pat. No. 4,741,020. It should be understood that, although glass panes are shown in the example provided, commercially-available cabinet locks may be used with other types of doors and enclosures, and the lock monitor module 30 may be designed for use with any such cabinet lock configurations.

Figure 1:
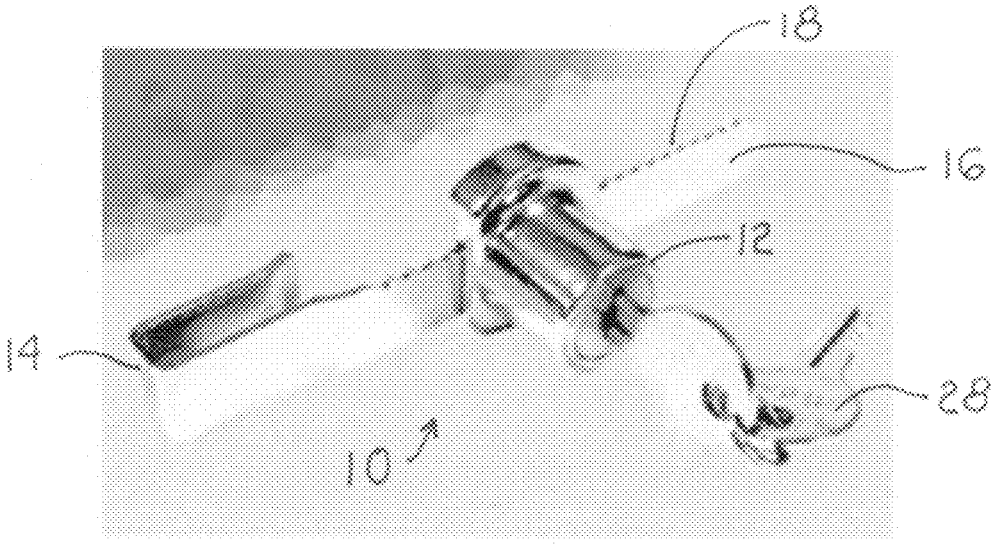
Fig. 1 (Prior Art)
FIG. 1 is an illustration of a display cabinet showcase lock, in accordance with prior art.
Figure 3:
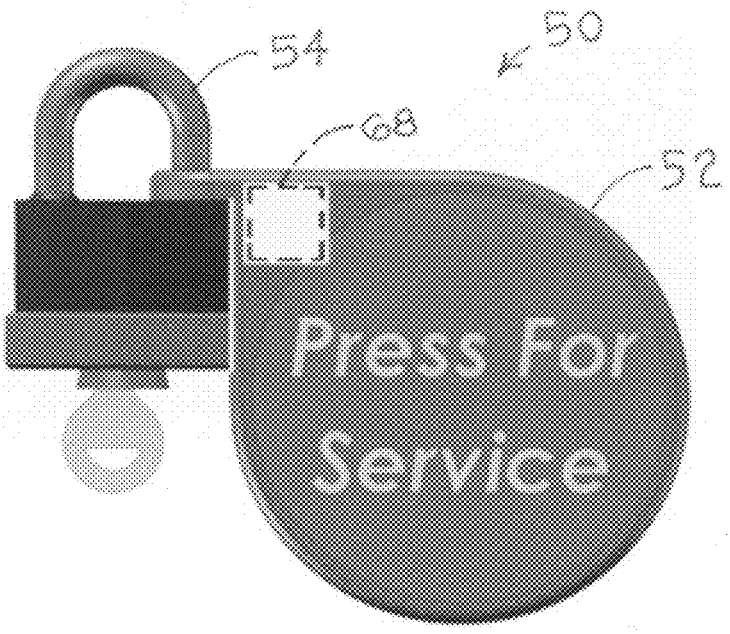
FIG. 3 is a pictorial illustration of a lock monitor module attached to the hasp of a padlock, in accordance with the present invention.

Alternatively, for a different configuration of display case, a padlock 50, such as shown in FIG. 3, may be used in place of the display cabinet showcase lock 20. A padlock monitor module 52 may be used to detect a physical action on the padlock 50, such as opening a padlock hasp 54. The padlock monitor module 52 may sense such physical actions or attempts to unlock the padlock 50, by means of a proximity or presence indicating device 68 (shown in phantom), such as a mechanical switch, a magnetic sensor, or an optical sensor, for example, as described above for use with the display cabinet showcase lock 20. As can be seen in the illustration, the padlock monitor module 52 includes the instruction "Press for Service" to summon assistance in opening the padlock 50. It can be appreciated that, in this regard, the written instruction serves the same function as does the help button 56 in FIG. 2.

Figure 4:
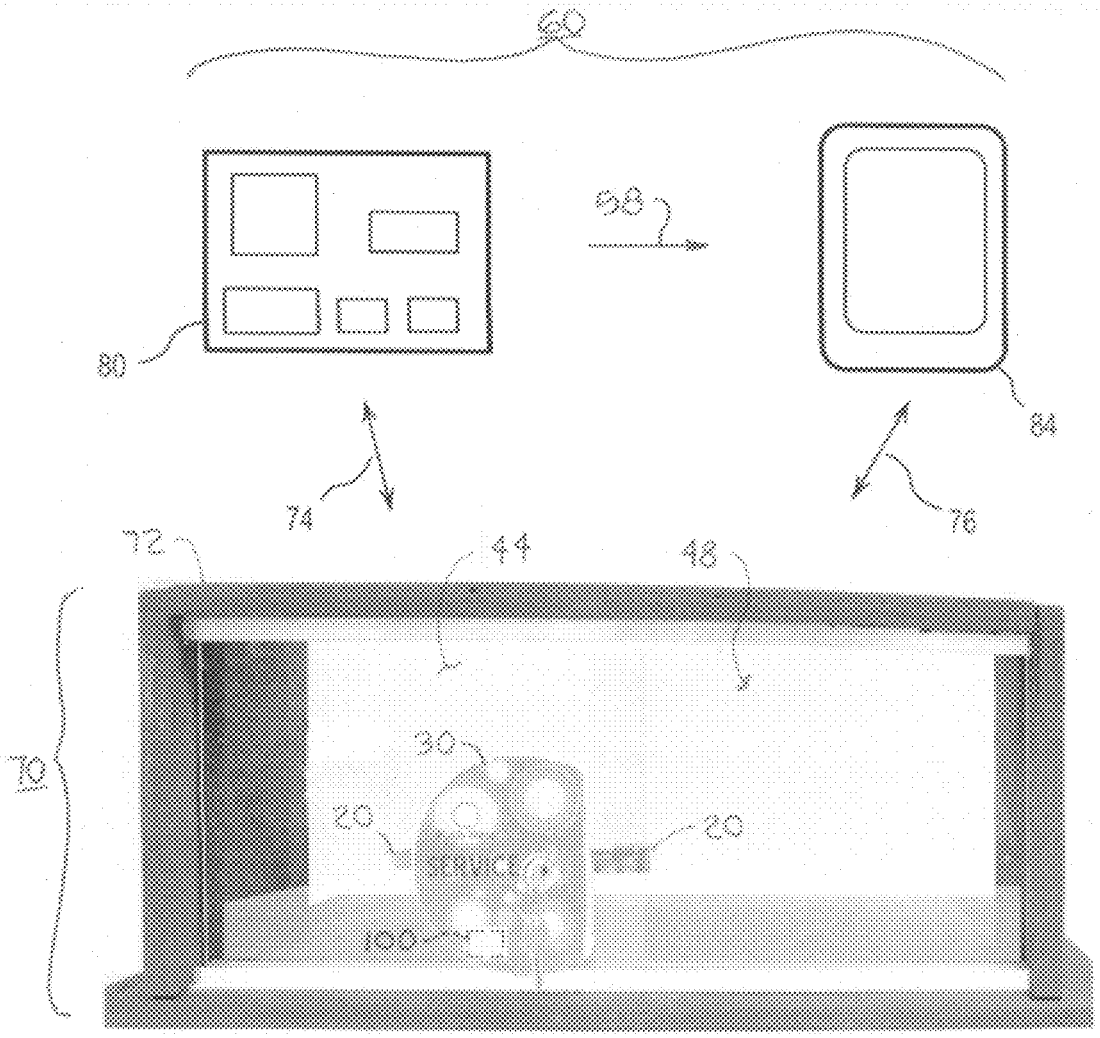
FIG. 4 is an illustration of the lock monitor module of FIG. 2 emplaced on a display cabinet and in communication with an alarm processor.

In an exemplary embodiment, shown in FIG. 4, the lock monitor module 30, the display cabinet showcase lock 20, and a display cabinet 70 may comprise part of a monitored lock system 60. In the example provided, the display cabinet 70 includes a cabinet 72 with the first glass pane 44 and the second glass pane 48. When the display cabinet showcase lock 20 has been unlocked, either or both of the glass panes 44, 48 may be slid open by the user.

Monitored actions can be detected by the lock monitor module 30 and a corresponding alarm signal 74 may be transmitted by an integral, low power radio transceiver 100 (shown in phantom) to an alarm processor 80 for: (i) evaluation, (ii) message notification, as appropriate, and (iii) activity data retention. Subsequently, the alarm processor 80 may transmit a notification signal 58 to a notification device 84. In an exemplary embodiment, the notification signal 58 may be configured for wireless transmittal to and reception by a wireless communication device, a pager, a two-way radio, a tablet computer, a personal computer, or a wireless phone, for example.

Alternatively, the monitored lock system 60 may operate in a peer-to-peer configuration in which the alarm processor 80 is not required for the messaging task. For example, the lock monitor module 30 may transmit a peer-to-peer notification signal 76 directly to the notification device 84, and thus achieve the desired notification functionality. It can be appreciated by one skilled in the art that the notification signal 76 issued by the lock monitor module 30 may have essentially the same signal parameters as the notification signal 58 issued by the alarm processor 80.

In accordance with the present invention, the lock monitor module 30 may monitor and report: (i) a locked state, (ii) an unlocked state, (iii) an effort to defeat the locking device through external force or mechanism (i.e., a tampered state), or (iv) a distressed state of the display cabinet showcase lock 20 mounted on the display cabinet 70. A distressed state may result if the showcase lock 20, and the locking barrel 22 in particular, is being shaken or forced by an intruder, for example. In an exemplary embodiment, the lock monitor module 30 may also report any activation of the help button 56. In addition, the lock monitor module 30 may also report, within a specified time interval, an opening of the display cabinet showcase lock 20 during unauthorized time periods, such as outside of normal business hours.

Figure 5:
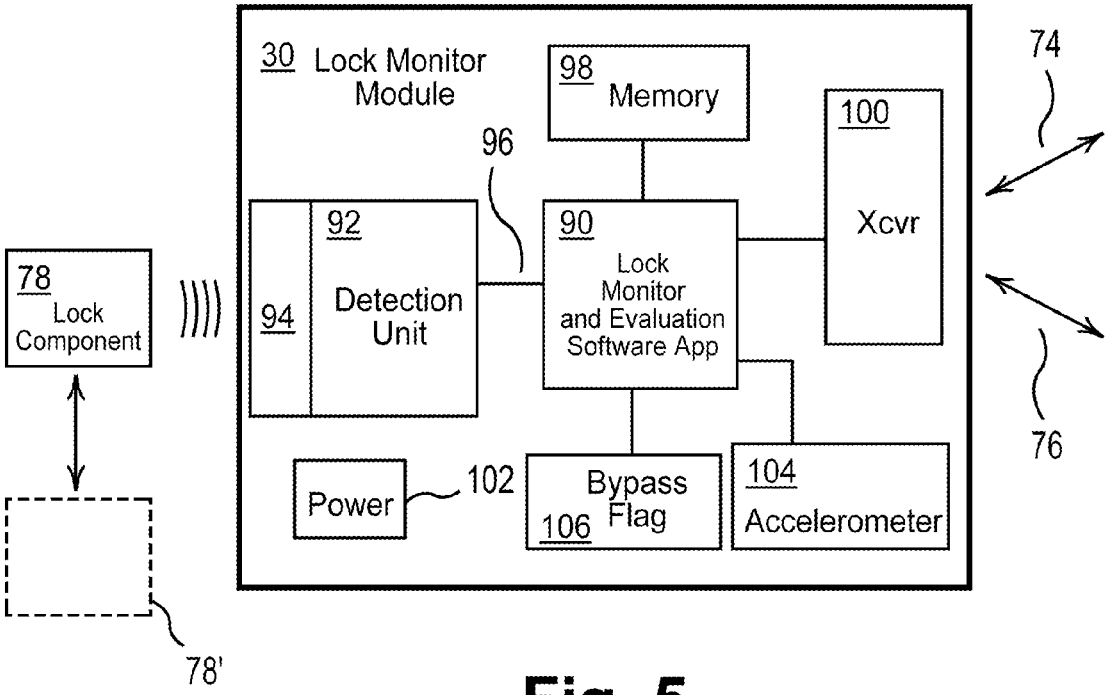
FIG. 5 is a functional block diagram of the lock monitor module of FIG. 2.
Figure 6:
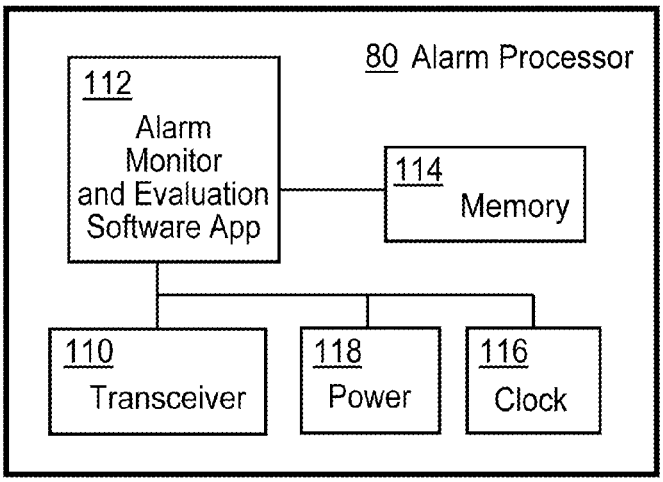
FIG. 6 is a functional block diagram of the alarm processor of FIG. 4.

The monitoring function may be accomplished by means of a detection unit 92 and a detection sensor 94 disposed in the lock monitor module 30, as shown in FIG. 5. It should be understood that the detection sensor 94 may comprise one or more of the optical sensor 62, the magnetic sensor 64, and the mechanical switch 66 as described above. Monitoring may be accomplished by assessing the state of interaction between the lock monitor module 30 and a lock component 78. The lock component 78 represents a component or part in a locking device that is designed to be rotated or otherwise moved to change the state of the locking device between a "locked state" and an "unlocked state." As such, the lock monitor module 30 is preferably adapted to the particular configuration of locking device suitable for use with a selected enclosure, a cabinet, a secured area, or a fenced-off open space.

Accordingly, as the lock component 78 is physically moved or rotated to a new position 78', (i) this motion of the lock component 78 or (ii) this removal of the lock component 78, may be detected by the detection sensor 94, and a corresponding locking device status signal 96 may be output by the detection unit 92. As stated above, the detection sensor 94 may comprise a mechanical sensor/switch, a magnetic sensor/switch, or an optical sensor/switch to sense the change in state of the lock component 78 from a locked configuration (i.e., denoted by lock component 78 having a solid line perimeter) to an "unauthorized configuration" (i.e., denoted by lock component 78' having a dashed line perimeter).

In an exemplary embodiment, the unauthorized configuration, or unauthorized lock opening, may be an unlocked state in which, for example: (1) the lock component 78 has been changed to a rotated status, (2) the lock component 78 has been changed to a removed status, (3) a ratchet bar has been removed, or (4) a padlock hasp has been opened.

The lock component 78 may, for example, incorporate a surface feature, such as an indicium, and the detected motion may occur when lock component 78 has been rotated or translated thus producing movement of the surface feature relative to the detection sensor 94. The rotation or translation of the lock component 78 may thus cause the movement of a component of a mechanical sensor/switch, or may activate or deactivate a magnetic sensor/switch.

Alternatively, an optical sensor/switch may be used to optically sense movement of the lock component 78 by: (i) interrupting a detector light beam when movement of the lock component 78 occurs, or (ii) optically detecting movement of one or more surface features or indicia on the lock component 78, as described above. Such detection of a surface feature may be enabled by illuminating the lock component 78 using a light-emitting diode in the lock monitor module, for example, and using an optical detector and readout circuitry, as is well-known in the relevant art, to sense change in the illumination reflected from the surface of the lock component 78, as is known in the art. In an exemplary embodiment, the optical detector may incorporate a band pass filter to pass the wavelength of the light-emitting diode and attenuate other ambient light.

The locking device status signal 96, obtained via the proximity or presence indicating device such as a mechanical sensor/switch, a magnetic sensor/switch, or an optical sensor/switch, may be provided by the detection unit 92 to the lock monitor and evaluation software app 90. The lock monitor and evaluation software app 90 may comprise custom firmware or an application-specific integrated circuit, for converting the locking device status signal 96 to an alarm signal 74 for subsequent transmittal to the alarm processor 80 and/or to a notification signal 76 for subsequent transmittal to the notification device 84.

Transmittal of the alarm signal 74 and the notification signal 76 may be made via the radio transceiver 100, as described in greater detail below. The lock monitor and evaluation software app 90 may also store data related to the detection event, such as the time and parameters of the locking device status signal 96, in a memory 98 for later retrieval by a user. Power for the lock monitor module 30 may be provided by a power source 102, such as a battery, an AC-powered electrical module, or a solar cell, as is well-known in the relevant art.

The lock monitor module 30 may further comprise an integral motion sensing device such as a three-axis accelerometer 104. The accelerometer 104 may be used to ascertain possible tamper incidents including, for example: (i) excessive prolonged movement not accompanied by a normal unlocking procedure, such as may occur when an unauthorized person is attempting to force the locked glass panes 44, 48, and (ii) re-orientation of the display cabinet showcase lock 20 without a normal unlocking procedure, such as may occur when the display cabinet showcase lock 20 is forcibly removed from the locked glass panes 44, 48. Detection of such tamper incidents may produce an alarm signal transmission by the lock monitor module 30 that can be used for notification and logging purposes, as described above.

In an alternative embodiment, the alarm processor 80 may operate to evaluate the alarm signal 74 from the lock monitor module 30, and then send the notification signal 76 as an appropriate audio or text message or signal, for example, to: (i) an overhead speaker, (ii) a pager, (iii) a two-way radio, (iv) a wireless phone, (v) a personal digital assistant (PDA), (vi) a "smart" device, and/or (vii) any other type of wireless communication device. The alarm signal 74 may also be sent to the remote alarm processor 80 if the display cabinet showcase lock 20 has been opened for a period of time that exceeds a pre-specified interval.

In an exemplary embodiment, the notification signal 76 may be a "machine-to-machine" signal, such as can be sent to a video analytics system (not shown) to "tag" tampering incidents for future investigation, or to drive an automatic video pop-up to monitoring personnel, so as to provide downstream alarm engine functionality. When the display cabinet showcase lock 20 is returned to the locked position, a follow-up status notification may be transmitted by the lock monitor module 30. A recorded transaction, including date, time, location, and total time unlocked, may be logged by the alarm processor 80.

In an exemplary embodiment, the alarm processor 80 may comprise an integral, low power radio transceiver 110 for receiving the alarm signal 74 from the lock monitor module 30. The received signal 74 is normally provided to an alarm monitor and evaluation software app 112 for evaluation, and may be sent to a memory 114 for storage in the alarm processor 80. A clock 116 may also be provided, for determination of the length of time the display cabinet showcase lock 20 was opened (i.e., in an unlocked state) before being closed (i.e., in a locked state). The alarm processor 80 may be powered by an electrical power source 118, such as a battery, a solar cell, or an AC line.

Figure 7:
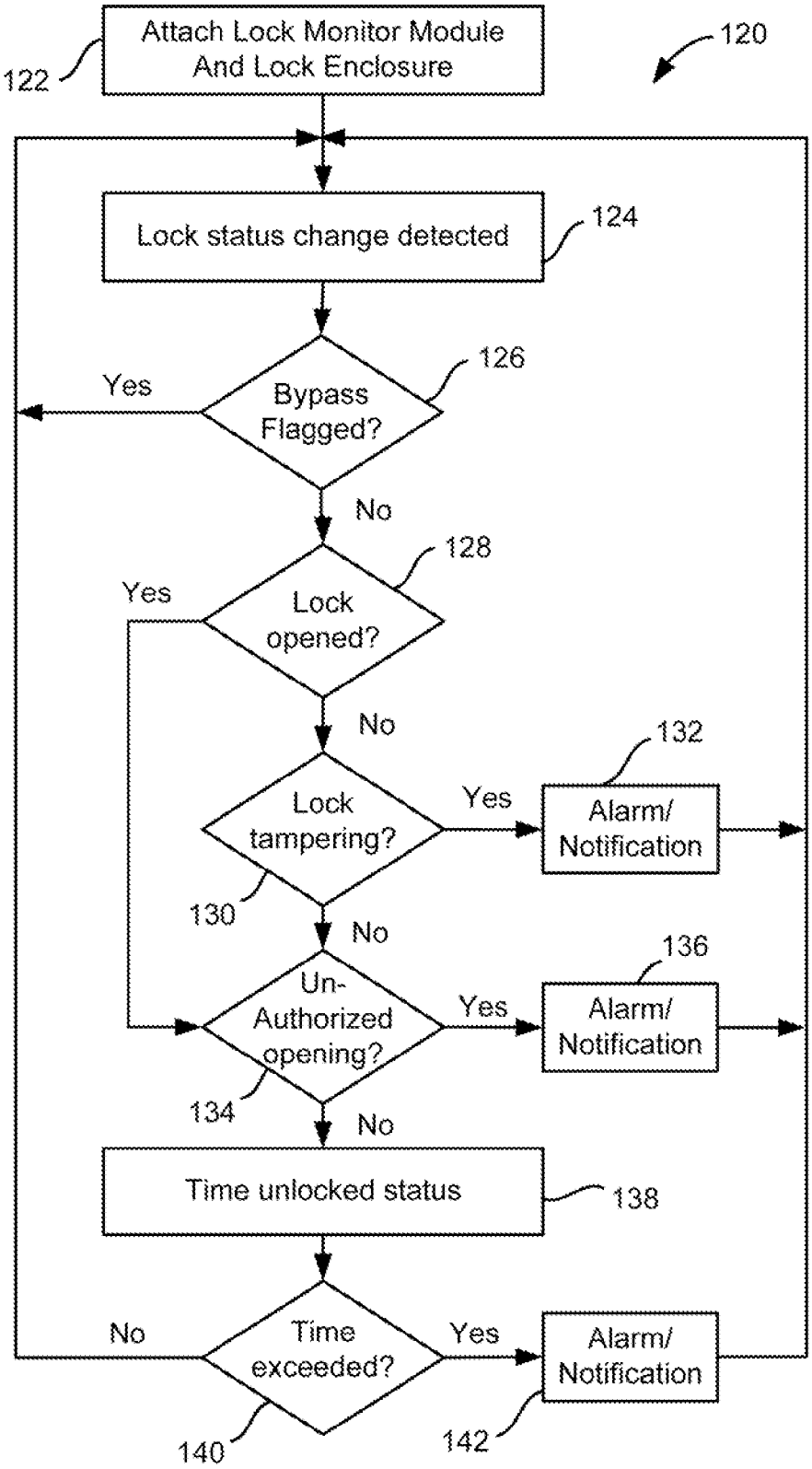
FIG. 7 is a flow diagram illustrating operation of the lock monitor module of FIG. 2; and, FIG. 8 is a flow diagram illustrating operation of the alarm processor of FIG. 4.

Operation of the monitored lock system 60 may be described with reference to a flow diagram 120, shown in FIG. 7. The lock monitor module 30 may be attached or secured to the display cabinet showcase lock 20, and the display cabinet 70, or other enclosure, may then be locked and secured, at step 122. The lock module monitor 30 may remain in an "idle" or monitor mode until a change in the status of the display cabinet showcase lock 20 is sensed by the detection unit 92, at step 124.

In an exemplary embodiment, the lock monitor and evaluation software app 90 can be placed into and out of a "bypass" or "passive" mode by a remote user. The user can transmit a bypass toggle signal to set or cancel a bypass signal flag 106 using a remote communication device, such as the notification device 84. When the bypass signal flag 106 is set, the lock monitor and evaluation software app 90 is in the "bypass" or "passive" mode, and inhibits sending either the alarm signal 74 or the notification signal 76 in response to receiving the locking device status signal 96. When the bypass signal flag 106 is canceled, the lock monitor and evaluation software app 90 is not in either the "bypass" or "passive" mode, and now functions to send the alarm signal 74 and/or the notification signal 76 in response to receiving the locking device status signal 96.

If the bypass signal flag 106 has been set in the lock monitor module 30, at decision block 126, the process returns to step 124. If no bypass signal flag 106 is set, an inquiry may be made by the lock monitor and evaluation software app 90, at decision block 128, as to whether the change in status detected at step 124 occurred while the display cabinet showcase lock 20 was in a locked state or in an "unauthorized state" such as an unlocked state. If the display cabinet showcase lock 20 was in a locked state, the process may return to step 124 to continue the monitoring of the status of the display cabinet showcase lock 20 as a locked state, an unlocked state, or in a tampered state.

If the display cabinet showcase lock 20 is understood to be in a locked state, at decision block 128, an inquiry may be made by the lock monitor and evaluation software app 90 as to whether another unauthorized state exists, that of a tampering event detected by the lock monitor and evaluation software app 90, at decision block 130. As can be appreciated by one skilled in the art, a tampered state may result from an effort to defeat the display cabinet showcase lock 20 through an external force or mechanism. Detection of a tampering event or a tampered state may be made in conjunction with a motion sensing device, such as the accelerometer 104 described above. If a tampering event has occurred, the alarm signal 74 may be sent to the alarm processor 80 and/or the notification signal 76 may be sent to the notification device 84, at step 132, notifying of the tampered state.

The detection unit 92 in the lock module monitor 30 comprises decision intelligence functioning to discern event state status of the lock component 78. For example, if no tampering event was detected by the detection unit 92, at decision block 130, an inquiry may be made, at decision block 134, as to whether the detected event may have been an "unauthorized lock opening" or similar unauthorized state of the display cabinet showcase lock 20. An unauthorized lock opening may include: (i) an act of unlocking the display cabinet showcase lock 20 during non-approved hours, such as when the retail facility is closed, or (ii) an act of unlocking the display cabinet showcase lock 20 by a person not verified as having authorization to open the display cabinet showcase lock 20. If an unauthorized opening has occurred, the alarm signal 74 may be sent to the alarm processor 80 and/or the notification signal 76 may be sent to the notification device 84, at step 136. The alarm processor 80 may issue a notification if the notice of unauthorized opening was received during hours designated as non-approved.

If the lock opening is recognized as being an authorized action, the lock monitor and evaluation software app 90 may function to time the duration of the unlocked status, at step 138. However, if the duration of the unlocked state or status exceeds an approved, specified time period, at decision block 140, the alarm signal 74 may be sent to the alarm processor 80 and/or the notification signal 76 may be sent to the notification device 84, at step 142. Otherwise, if the unlocked status is changed back to a locked state or status within the approved, specified time period, at decision block 140, the process may return to step 124.

In an alternative embodiment, the authorized person may be required to perform a secondary action immediately before or after unlocking the display cabinet showcase lock 20, or after an alarm has sounded, so as to extend the time period used in decision block 140 before the alarm or a signal might be transmitted. This procedure may be used in place of setting the bypass signal flag 106 when, for example, the merchandise in the display case is being replaced with new stock. Failure to perform the secondary action may cause an "unauthorized person" alarm to be transmitted.

The secondary action may comprise having the authorized user anticipate or respond to the alarm by: (i) scanning a nearby barcode/QR code and thus alerting the lock monitor and evaluation software app 90, (ii) providing a Near Field Communication (NFC) tag proximate the lock monitor module 30 to alert the lock monitor and evaluation software app 90, and/or (iii) entering a private code via a keypad or by voice command, and transmitting to the lock monitor and evaluation software app 90. It should be understood that any of the secondary actions function to either prevent, or terminate, the transmittal of an alarm or notification by the lock monitor module 30.

Figure 8:
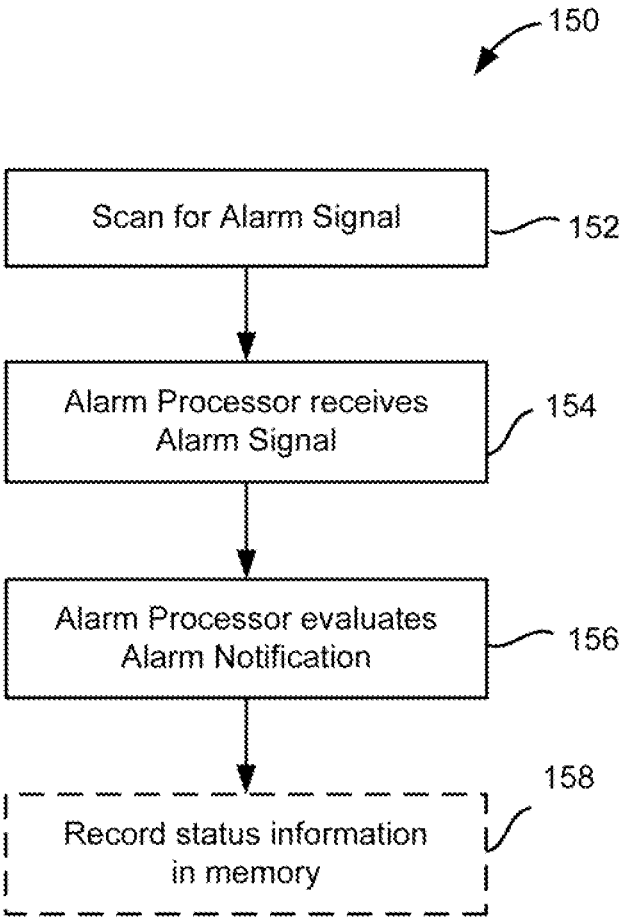

Operation of the alarm processor 80 may be described with reference to a flow diagram 150, shown in FIG. 8. The radio transceiver 110 in the alarm processor 80 may continually scan for the alarm signal 74, at step 152. When the alarm processor 80 receives the alarm signal 74, at step 154, the alarm processor 80 may issue a notification of the received alarm signal 74 to the appropriate recipient, at step 156. The alarm processor 80 may optionally record and store data related to the alarm signal 74 in the memory 114, at step 158.

It is to be understood that the description herein is exemplary of the invention only and is intended to provide an overview for the understanding of the nature and character of the disclosed monitored lock systems. The accompanying drawings are included to provide a further understanding of various features and embodiments of the method and devices of the invention which, together with their description serve to explain the principles and operation of the invention.

What is claimed is:

1. A lock monitor module suitable for attachment to a locking device, said lock monitor module comprising:

a detection sensor in communication with a detection unit, said detection unit for generating a locking device status signal representative of at least one of a locked state, an unlocked state, a tampered state produced through external force or mechanism, or a distressed state of the locking device, said sensor proximate to a locking barrel in the locking device, said locking barrel enclosed by said lock monitor module;

a lock monitor and evaluation software app in communication with said detection unit for receiving said locking device status signal; and a radio transceiver for transmitting at least one of an alarm signal and a notification signal in response to receiving said locking device status signal from said lock monitor and evaluation software app.

2. The lock monitor module of claim 1 further comprising a memory for storing data representative of at least one of said locked state, said unlocked state, said tampered state, or said distressed state of the locking device.

3. The lock monitor module of claim 1 wherein said detection sensor comprises one of a mechanical sensor, a mechanical switch, a magnetic switch, a magnetic sensor, an optical sensor, or an optical switch to sense change in state of said lock component from said locked state to said unlocked state.

4. The lock monitor module of claim 1 further comprising at least one of an accelerometer or a motion sensing device for sensing at least one of said tampered state or said distressed state of the locking device.

5. The lock monitor module of claim 1 said lock monitor module is configured for attachment to a display cabinet showcase lock.

6. The lock monitor module of claim 1 wherein said lock monitor and evaluation software app further comprises a selectable bypass flag responsive to a bypass toggle signal received at said transceiver, activation of said bypass flag functioning to inhibit said transmitting of at least one of said alarm signal or said notification signal.

7. The lock monitor module of claim 1 further comprising a button, wherein activation of said button by a user functions to summon assistance to unlock the locking device.

8. The lock monitor module of claim 1 further comprising a clock for determining a length of time between said unlocked state and said locked state.

9. A monitored lock system suitable for providing security for an item placed into an enclosure, said system comprising:

a locking device for locking the enclosure, said locking device including a locking barrel;

a lock monitor module enclosing said locking barrel, said lock monitor module including a detection unit for generating a locking device status signal representative of a locked state of said locking device or an unauthorized state of said locking device, said lock monitor module further including a lock monitor and evaluation software app for converting said locking device status signal into at least one of: (i) an alarm signal configured for transmittal to a first radio transceiver and (ii) a notification signal configured for transmittal to a mobile communication device.

10. The monitored lock system of claim 9 wherein said unauthorized state of said locking device comprises at least one of an unlocked state of said locking device, a tampered state produced from an effort to defeat the locking device through external force or mechanism, or a distressed state of said locking device.

11. The monitored lock system of claim 9 further comprising an alarm processor in communication with said lock monitor module, said alarm processor including said first radio transceiver for receiving said alarm signal, said alarm processor further configured for converting said alarm signal into said notification signal for transmittal to said mobile communication device.

12. The monitored lock system of claim 11 wherein said alarm processor functions to continually scan for said alarm signal, wherein upon receiving said alarm signal said alarm processor functions to perform at least one of: (i) transmitting said notification signal and (ii) storing in a memory data related to said received alarm signal.

13. The monitored lock system of claim 9 wherein said lock monitor module comprises a second radio transceiver for communicating with said first radio transceiver.

14. The monitored lock system of claim 9 further comprising a sensor in communication with said detection unit, said sensor configured to sense change in the state of said locking device from said locked state to said unauthorized state.

15. A method of providing security for an item placed into a secured area, said method comprising the steps of:

attaching a lock monitor module to a locking device, said locking device including a locking barrel;

placing said locking device into a locked state using said locking barrel;

monitoring said locking device so as to detect a change from said locked state;

if an unauthorized lock opening has occurred to produce a change in said locked state, generating a locking device status signal; and transmitting at least one of an alarm signal and a notification signal in response to said step of generating said locking device status signal, said alarm signal configured for transmittal to a radio transceiver, said notification signal configured for transmittal to a mobile communication device.

16. The method of claim 15 further comprising the step of transmitting said notification signal to at least one of a pager, a two-way radio, a personal data assistant, a tablet computer, a personal computer, and a wireless phone.

17. The method of claim 15 further comprising the step of generating said locking device status signal if at least one of: (i) a tampered state of said locking device is detected, or (ii) a distressed state of said locking device is detected.

18. The method of claim 15 further comprising the step of initiating a secondary action in response to said step of producing at least one of an alarm signal and a notification signal, wherein said secondary action functions to terminate at least one of said alarm signal and said notification signal.

19. The method of claim 18 wherein said step of initiating a secondary action comprises at least one of the steps of: (i) scanning a barcode to terminate said alarm signal or notification signal, (ii) sensing a near-field communication tag to terminate said alarm signal or notification signal, and (iii) entering a private code via a keypad or by voice command to terminate said alarm signal or notification signal.

20. The method of claim 15 wherein said unauthorized lock opening may comprise at least one of: (i) unlocking said locking device during non-approved hours, or (ii) unlocking said locking device by an unauthorized person.

* * * * *